US011739754B2

(12) United States Patent
Fagerli et al.

(10) Patent No.: US 11,739,754 B2
(45) Date of Patent: Aug. 29, 2023

(54) COMPRESSOR MODULE HAVING OIL SEPARATOR AND ELECTRIC-POWERED REFRIGERANT COMPRESSOR HAVING THE SAME

(71) Applicant: Brose Fahrzeugteile SE & Co. Kommanditgesellschaft, Würzburg, Würzburg (DE)

(72) Inventors: Björn Fagerli, Rosbach - Rodheim (DE); Budi Rinaldi, Frankfurt am Main (DE); Dennis Ryma, Rottendorf (DE); Pierre Schmitt, Karlstadt (DE)

(73) Assignee: Brose Fahrzeugtelle SE & Co. Kommanditgesellschaft, Würzburg (DE)

( * ) Notice: Subject to any disclaimer, the term of this patent is extended or adjusted under 35 U.S.C. 154(b) by 0 days.

(21) Appl. No.: 17/270,781

(22) PCT Filed: Aug. 21, 2019

(86) PCT No.: PCT/EP2019/072366
§ 371 (c)(1),
(2) Date: Feb. 23, 2021

(87) PCT Pub. No.: WO2020/038993
PCT Pub. Date: Feb. 27, 2020

(65) Prior Publication Data

US 2021/0180595 A1 Jun. 17, 2021

(30) Foreign Application Priority Data

Aug. 24, 2018 (DE) ..... 10 2018 214 370.6
Oct. 19, 2018 (DE) ..... 10 2018 217 911.5

(51) Int. Cl.
*F04C 29/02* (2006.01)
*F04C 18/02* (2006.01)
*F04C 29/12* (2006.01)

(52) U.S. Cl.
CPC ..... *F04C 29/026* (2013.01); *F04C 18/0215* (2013.01); *F04C 29/12* (2013.01);
(Continued)

(58) Field of Classification Search
CPC .... F04C 29/026; F04C 18/0215; F04C 29/12; F04C 2210/26; F04C 2240/30; F04C 2240/40
See application file for complete search history.

(56) References Cited

U.S. PATENT DOCUMENTS 9,885,359 B2 * 2/2018 Nagano ..... F04C 18/3441
2002/0054823 A1 * 5/2002 Hida ..... F04C 29/026 418/201.2

(Continued)

FOREIGN PATENT DOCUMENTS

CN 104179681 A 12/2014
DE 69823117 T2 4/2005

(Continued)

OTHER PUBLICATIONS

English Machine Translation of JP2003-214344A (Year: 2003).*

(Continued)

*Primary Examiner* — Dominick L Plakkoottam
*Assistant Examiner* — Paul W Thiede
(74) *Attorney, Agent, or Firm* — Dickinson Wright PLLC

(57) ABSTRACT

A compressor module with an pot-shaped compressor casing with a casing bottom and a casing wall which has an outlet for a compressed refrigerant, with a separator device for separating a lubricant mixed in with the refrigerant, the separator device is introduced into a high-pressure chamber (Continued)

of the compressor casing, wherein the separator device has a hollow-cylindrical chamber wall which forms a separation chamber fluidically connected to the outlet, and the a separator is received in the separation chamber to form an annular space.

19 Claims, 6 Drawing Sheets

(52) U.S. Cl.
CPC ..... *F04C 2210/26* (2013.01); *F04C 2240/30* (2013.01); *F04C 2240/40* (2013.01)

(56) References Cited

U.S. PATENT DOCUMENTS

2004/0170517 A1* 9/2004 Kawata ..... F01C 21/10 418/270
2006/0065012 A1 3/2006 Kudo
2009/0246061 A1* 10/2009 Iijima et al. ..... F04C 29/026 96/400
2012/0156072 A1* 6/2012 Usui ..... F01C 21/10 417/437
2014/0348682 A1* 11/2014 Obrist ..... F04C 18/0215 418/55.5
2015/0192126 A1* 7/2015 Nagano ..... F04C 18/0215 417/410.5
2015/0361981 A1 12/2015 Kawano
2016/0138446 A1* 5/2016 Reichelt ..... F01M 13/04 123/573
2017/0284397 A1 10/2017 Nagano et al.

FOREIGN PATENT DOCUMENTS

DE 102015223401 A1 6/2016
DE 102016107194 A1 10/2017
JP 04153596 A * 5/1992
JP 2003013858 A * 1/2003
JP 2003201964 A * 7/2003 ..... F04C 18/3446
JP 2003214344 A 7/2003
JP 2004211550 A 7/2004
JP 2008057389 A 3/2008
JP 2010001837 A * 1/2010
JP 2016205203 A 12/2016
WO WO-2017163809 A1 * 9/2017 ..... F25B 43/02
WO 2018151061 A1 12/2019

OTHER PUBLICATIONS

English Machine Translation of JP2003-013858A via Espacenet (Year: 2003).*
English Machine Translation of JP2010001837A via USPTO Fit Database (Year: 2010).*

* cited by examiner

COMPRESSOR MODULE HAVING OIL SEPARATOR AND ELECTRIC-POWERED REFRIGERANT COMPRESSOR HAVING THE SAME

CROSS-REFERENCE TO RELATED APPLICATIONS

This application is the U.S. National Phase of PCT Application No. PCT/EP2019/072366 filed on Aug. 21, 2019, which claims priority to German Patent Application Nos. DE 10 2018 217 911.5, filed on Oct. 19, 2018 and DE 10 2018 214 370.6 filed on Aug. 24, 2018, the disclosures of which are hereby incorporated in their entirety by reference herein.

TECHNICAL FIELD

The present disclosure relates to a compressor module, such as an electromotive refrigerant compressor having such a compressor module.

BACKGROUND

In motor vehicles, there is generally installed an air-conditioning system which can cool the vehicle interior in the manner of a compression refrigerating machine. Such systems in principle have a circuit in which a refrigerant, for example, R-134a (1,1,1,2-tetrafluoroethane) or R-774 ($CO_2$) is guided. During operation, the refrigerant is compressed by means of a (refrigerant) compressor or condenser, which leads to a pressure and temperature increase of the refrigerant. In particular, the compressor is in this instance operated by an electric motor.

SUMMARY

One or more objects of the present disclosure is to provide a suitable compressor module and an electromotive refrigerant compressor having such a compressor module. As an example, the compressor housing may be produced in an economical manner and/or a pressure pulse should be prevented.

To this end, the compressor module has a substantially pot-like compressor housing having a housing base and having a housing wall. The compressor housing is also referred to as a compressor head housing. Furthermore, the housing wall has an outlet for a compressed refrigerant. The compressor module further comprises a separation device (lubricant separator) for separating a lubricant which is mixed with the refrigerant. In this instance, the separation device is introduced into a high-pressure chamber (compression chamber) of the compressor housing.

The separation device has a hollow-cylindrical, such as tubular, chamber wall, which forms a separation chamber which is connected in technical flow terms to the outlet. The chamber wall thus delimits the separation chamber from the high-pressure chamber. The separation device further has a separator which is received in the receiving chamber with an annular space being formed. As an example, the center axis of the separation device extends parallel with the housing base, such as in a radial direction of the housing base.

As an example, the separator is also constructed in a hollow-cylindrical manner through the passage of which the compressed refrigerant flows toward the outlet. The separator may be arranged coaxially with the chamber wall.

The separation device may be constructed as a separate component which can be introduced or is introduced into the high-pressure chamber. The separation device, such as the chamber wall thereof, is thus not constructed in a coherent manner with the compressor housing or integrated therein. As a result, a tool for producing the compressor housing can be and is constructed in a comparatively simple manner. As an example, no sliding member is required in order to form the separation chamber. Costs for producing the compressor housing may be reduced.

For example, a mixture of refrigerant and lubricant also collectively referred to as fluid is supplied for operational reasons from a compressor component outlet of the compressor component, such as via a valve, in a pulsed (intermittent) manner into the high-pressure chamber. Accordingly, in the high-pressure chamber and also in technical flow components of the refrigerant circuit arranged downstream therein a time-varying pressure path occurs, which is referred to below as pressure pulsation. This may in a disadvantageous manner lead, for example, to noise generation in the refrigerant circuit. Such a pressure pulsation is particularly prevented or at least reduced by a volume, in which the fluid is discharged in a pulsed manner, being constructed to be correspondingly large. As a result of the fact that the separation device is introduced into the high-pressure chamber and not integrated in the housing base, the corresponding casting geometry for the separation chamber is dispensed with. Thus, a consistent structural space of the compressor housing, additional space (an additional volume) is formed between the separation device and the housing base, for which reason a pressure pulsation is reduced. Consequently, a pressure pulsation in the high-pressure chamber and for example the resultant noise generation may be reduced.

The lubricant may be a/an (lubricant) oil, and the term "oil" is intended to be understood to refer to mineral oils in a non-limiting manner. Instead, fully synthetic or partially synthetic oils, for example, silicone oils, or other oil-like fluids, such as hydraulic fluid or cooling lubricants, can also be used. The separation device is thus also referred to as an oil separator.

Using the separation device, the lubricant is separated from the refrigerant or from the fluid in the manner of a centrifugal separator (cyclone separator). The fluid flowing into the separation chamber is guided in the cylindrical separation chamber in the manner of a helix (in the manner of a cyclone) along the separator. In this instance, centrifugal forces act on the mixture of refrigerant and lubricant as a separation mechanism.

According to another embodiment, the separation device is constructed in one piece. That is to say, the chamber wall and the separator are constructed in a coherent (monolithic) manner. In a suitable manner, the separation device is produced by means of an injection-molding method, such as from a plastics material, in a comparatively economical manner. Such injection-molding methods further enable comparatively complex contours, in order to improve the (cyclone action) separation action, to be formed by the separation device. For example, a helical guide for the fluid which protrudes into the separation chamber may be formed on the chamber wall.

According to another development, the outlet forms a (plug type) receiving member for the separation device. For example, the separation device is introduced during assembly through the outlet into the high-pressure chamber. That is to say, the separation device is an insertion component. In this instance, the separation device is located at the end side in the outlet.

To this end, according to one embodiment, the separator projects beyond the separation chamber in the direction of the center axis of the separation device. In this instance, the separator has in the region which protrudes beyond the separation chamber at the outer side a guiding contour for the separation device in the outlet. For example, the guiding contour is constructed as a number of ribs so that the separation device during assembly remains centered during guiding through the outlet and consequently a displacement, for example tilting with respect to the provided assembly direction, is prevented.

Furthermore, the separator may expand in this region which projects beyond the separation chamber so that an outer wall of the separator is formed on an inner wall of the outlet. In this instance, the outlet may be circular in cross-section. Accordingly, the separator expands in a conical manner so that the outer diameter thereof is equal to the inner diameter of the outlet.

In another embodiment, the chamber wall has an inlet opening for coupling the separation chamber to the high-pressure chamber in technical flow terms. In this instance, in an embodiment the inlet opening opens in a radially offset manner with respect to the center axis of the separation device in the separation chamber. Additionally or alternatively, the inlet opening is constructed in the manner of a slot in the direction of the center axis of the separation device. As a result of the radially offset inlet opening, the compressed fluid flows tangentially into the annular space formed between the separator and the chamber wall. Consequently, the fluid is selectively guided along at only one side of the separator, an undesirable formation of turbulence is prevented and the lubricant is better separated. As an example, the flow cross-section formed by the clear width of the inlet opening is adapted by means of the slot-like construction in the direction of the center axis, even with tangential influx of the fluid into the annular space—and consequently even with a correspondingly radially offset arrangement of the inlet opening—to a conveying volume which occurs during operation.

In one or more embodiments, the inlet opening faces the housing base. In this manner, the inlet opening of the chamber wall is not opposite a compressor component outlet, that is to say, the inlet opening of the chamber wall faces away from the compressor outlet, from which the compressed fluid flows out of the compressor component into the high-pressure chamber, in particular in a pulsed manner. Consequently, a comparatively uniform influx of the fluid into the separation device is brought about.

In another embodiment, the separator has in the region which protrudes beyond the separation chamber a radially outwardly and upwardly extending retention contour. This contour may be arranged at the end side, that is to say, at the end of the separator facing away from the separation chamber. The retention contour is in this instance received in a corresponding seat of the outlet. For example, the retention contour is constructed as a hook-like continuation which extends upward in a direction perpendicular to the center axis of the separation device. In this instance, a wall of the seat which is orientated perpendicularly to the center axis of the separation device forms a first support (first shoulder) with respect to the direction along the center axis for the separation device. A wall which is orientated parallel with the center axis forms a second abutment (second shoulder) for the retention contour against twisting of the separation device about the center axis thereof, that is to say, in a peripheral direction of the separation device.

In addition, the separation device is located in the compressor housing with a press-fit being formed. The press-fit is in this instance formed in particular by means of the chamber wall and in the receiving member which is connected to the lubricant reservoir and additionally or alternatively by means of the separator and the outlet. As a result of the press-fit, a twisting is already prevented or at least a risk thereof is considerably reduced.

The end of the chamber wall which faces away from the outlet may be located in a receiving member of the compressor housing which is connected to a lubricant reservoir.

In one or more embodiments, the chamber wall has a recess for receiving a twisting prevention means. As an example, the recess is arranged at the end of the chamber wall facing away from the outlet. Thus, it is made possible for the twisting prevention means to be introduced into the receiving member which is connected to the lubricant reservoir. In addition, the recess acts as an auxiliary orientation member during the assembly. The twisting prevention means is in this instance provided and configured alternatively or additionally to securing against twisting of the separation device by means of the retention contour which is arranged on the separator. This receiving member consequently performs a dual function. For example, the twisting prevention means is constructed as a pin or a screw element. As an example, the twisting prevention means is introduced during assembly into a corresponding passage of the receiving member which is connected to the lubricant reservoir and into the recess of the chamber wall which is in alignment with this passage. In summary, the separation device is consequently secured against rotation in a manner secured to the housing.

In another embodiment, an electromotive refrigerant compressor for compressing a refrigerant of a motor vehicle has a compressor module in one of the above-described variants. In addition, the electromotive refrigerant compressor has a motor module having the electric motor.

In this instance, the compressor component may be supported by the compressor housing. In a suitable manner, the compressor component is constructed as a so-called scroll compressor. This compressor operates in the manner of a displacement pump, and a movable scroll component is driven eccentrically with respect to a stationary scroll component, in particular by means of an electric motor, and in this instance the fluid is compressed. The scroll components are in this instance typically constructed as a helix or scroll pair which can be fitted one inside the other. In this instance, one of the helixes is stationary with respect to the compressor housing and engages at least partially in a second helix which is driven in an orbiting manner by means of an electric motor. An orbiting movement is in this instance intended to be understood in particular to be an eccentric circular movement path, in which the second helix itself does not rotate about its own axis. There are thereby formed with each orbiting movement between the helixes two substantially sickle-like refrigerant chambers, whose volumes are reduced (compressed) during the movement. The refrigerant is discharged via an outlet in the stationary scroll component into the high-pressure chamber.

BRIEF DESCRIPTION OF THE DRAWINGS

An embodiment of the invention is explained in greater detail below with reference to the drawings, in which.

Mutually corresponding components and variables are always given the same reference numerals in all the Figures.

DETAILED DESCRIPTION

Figure 1:
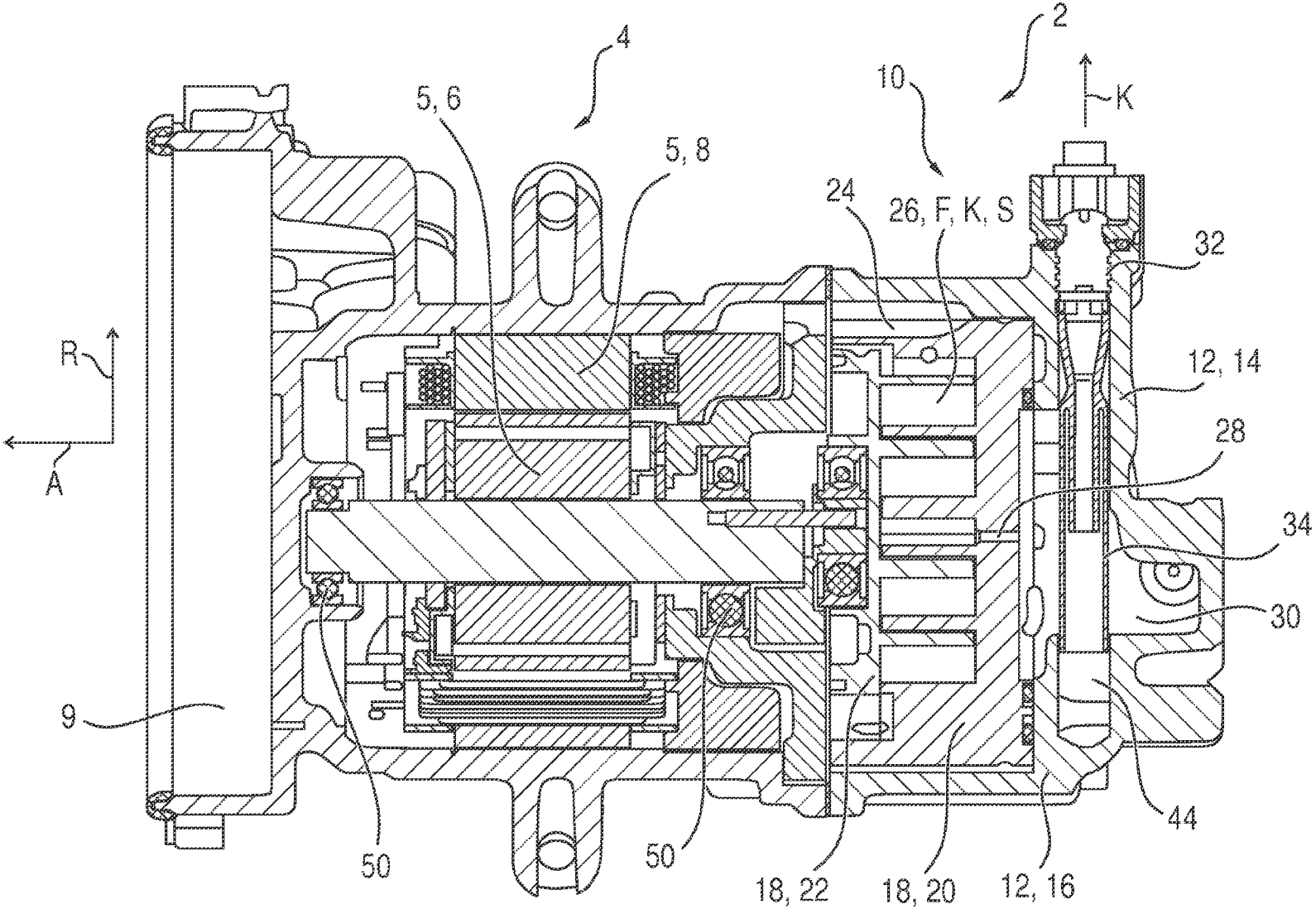
FIG. 1 is a longitudinal section of an electromotive refrigerant compressor with a motor module having the electric motor and with a compressor module.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Within the compressor, there is further provided a lubricant which is mixed with the gaseous refrigerant during operation. The lubricant, in particular oil, serves to reduce friction which occurs and which during operation is produced in the compressor between a first compressor component element and a second, fixedly supported compressor component element at the high-pressure side. Furthermore, the lubricant performs a sealing function so that any (refrigerant) leakages which are produced between the compressor component elements are reduced to the greatest possible extent or completely prevented, which increases the degree of efficiency of the refrigerant compressor.

In the compressor and at that location in the (compressor) housing thereof, in the flow direction a compressor component which is provided to convey the fluid formed by means of the lubricant and the refrigerant from an inlet at the low pressure side to an outlet at the high pressure side and to compress the fluid, a high-pressure chamber (compression chamber) and a separation device are arranged one behind the other. In the separation device, the lubricant is separated from the refrigerant so that the separated lubricant is or can be returned to the compressor and the refrigerant is directed in a lubricant-free manner to the greatest possible extent via an outlet of the separation device into the refrigerant circuit.

In this instance, the separation device is in particular integrated in the compressor housing. At least one chamber wall which surrounds a separation chamber of the separation device is thus formed by means of the compressor housing.

DE 698 23 117 T2 discloses, for example, a helical compressor in which a rear housing delimits an oil separation chamber.

Furthermore, US 2006/0065012 A1 discloses a compressor having an oil separator which has a cylindrical hole having a separation pipe which is received therein. In this instance, the hole is arranged inside a wall of a rear housing.

In order to produce a compressor housing having such an integrated separation device, however, a comparatively complex (casting) tool geometry and in particular in addition a sliding member are required. As a result, the production of the compressor housing and consequently of the compressor is comparatively complex and cost-intensive.

In compressors, a pressure pulse, that is to say, a time-varying pressure path may further occur and is brought about in particular by means of a pulsed (intermittent) output of the compressed fluid into the high-pressure chamber. This pressure pulse may, for example, also continue in technical flow components of the refrigerant circuit which are arranged downstream of the high-pressure chamber and also in a disadvantageous manner lead, for example, to noise generation in the refrigerant circuit.

The electromotive refrigerant compressor 2, which is illustrated in FIG. 1 and which is also referred to as a compressor 2 below for short, may be installed or can be installed as an electromotive refrigerant compressor 2 in a refrigerant circuit (which is not illustrated in greater detail) of an air-conditioning system of a motor vehicle. The compressor 2 is in this instance constructed to be modular. It thus comprises a motor module 4 having an electric motor 5 which in turn comprises a rotor 6 and a stator 8 and having an electronics compartment 9 which receives an electronic system which is not illustrated in greater detail for controlling the electric motor 5. Furthermore, the compressor 2 comprises a compressor module 10 which is joined to the motor module 4.

The compressor module 10 has a substantially pot-like compressor housing 12 (housing 12) having a housing base 14 and having a housing wall 16. A compressor component 18 is supported in the compressor housing 12 and is drivingly connected to the electric motor 5 of the motor module 4. The compressor component 18 has a first compressor component element 20 which is stationary with respect to the compressor housing 12 and a movable second compressor component element 22 which engages therein. The compressor component 18 is in this instance constructed as a scroll compressor.

Within the compressor 2, there is provided a lubricant S which is used to lubricate the compressor component 18 and which performs a sealing function so that leakages are prevented between the compressor component elements 20 and 22. For operational reasons in this instance, a refrigerant K which is compressed by means of the compressor component and the lubricant S are mixed to form the fluid F. The fluid F flows at the low-pressure side of the compressor component 18 through a compressor inlet 24 into a compressor component chamber 26. There, the fluid F is compressed, and the compressor component 18 acts in the manner of a displacement pump. Subsequently, the fluid F flows out of the compressor component 18 through a high-pressure-side compressor component outlet 28 into a high-pressure chamber 30.

The radial direction with respect to the compressor housing 12 and the axial direction perpendicular to the housing base 14 in the direction of the compressor component 18 are designated R and A in the accompanying directional diagram, respectively.

Figure 2:
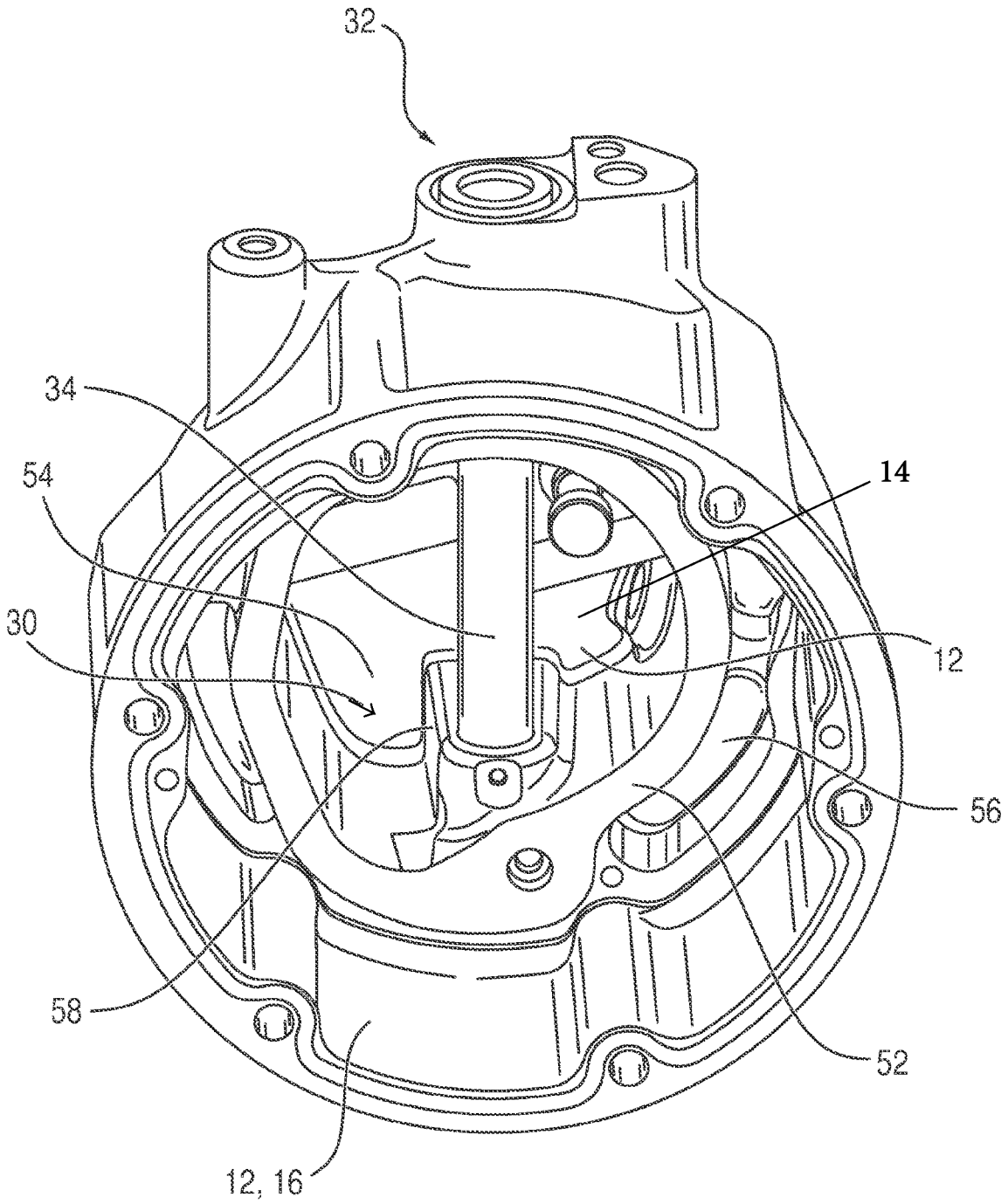
FIG. 2 is a perspective illustration of a compressor housing of the compressor module, and a housing wall of the compressor housing has an outlet for a compressed refrigerant, and the outlet forms a receiving member for a separation device.
Figure 3:
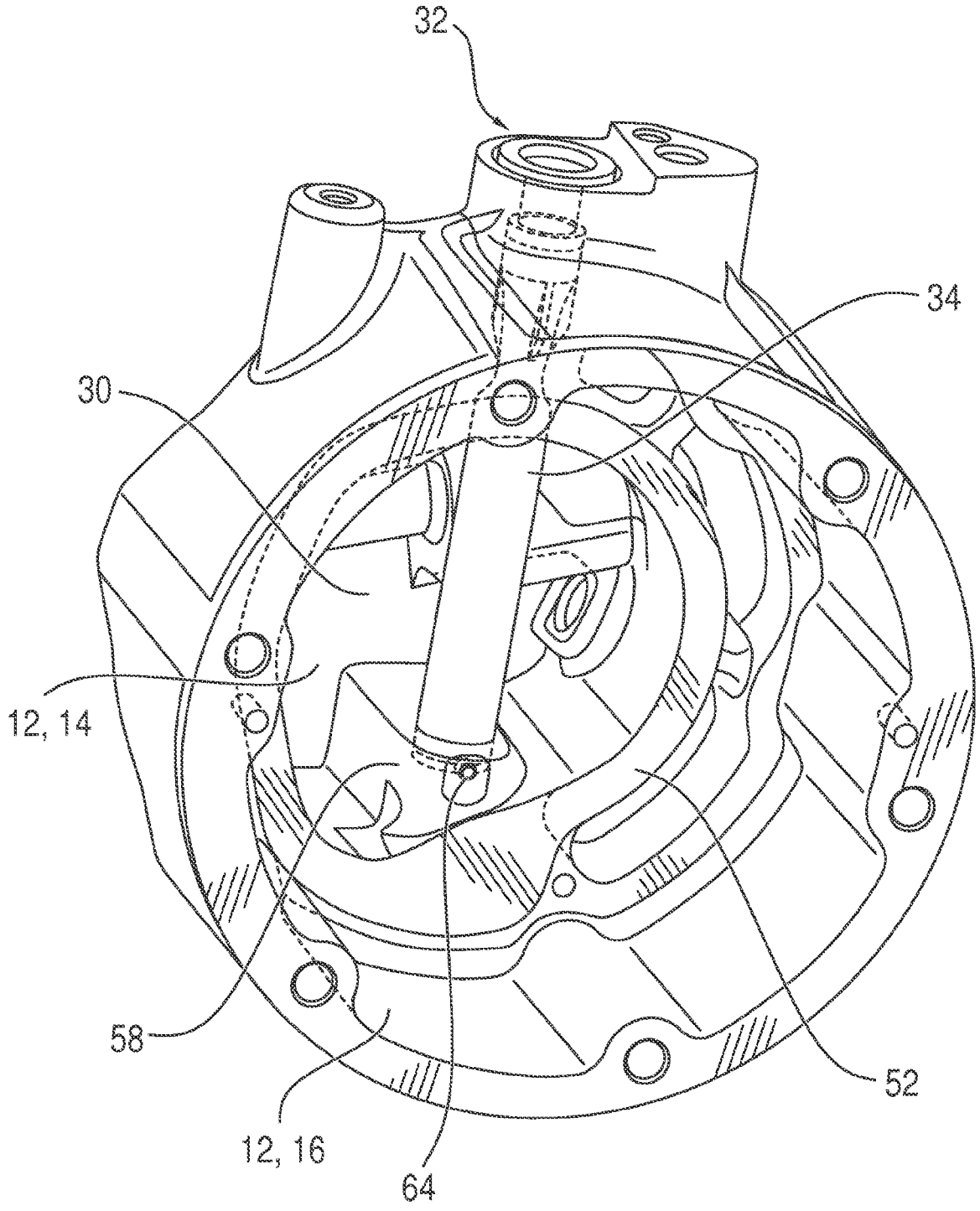
FIG. 3 is a perspective view of the compressor housing with a separation device introduced therein, and the compressor housing is illustrated in a transparent manner.
Figure 5:
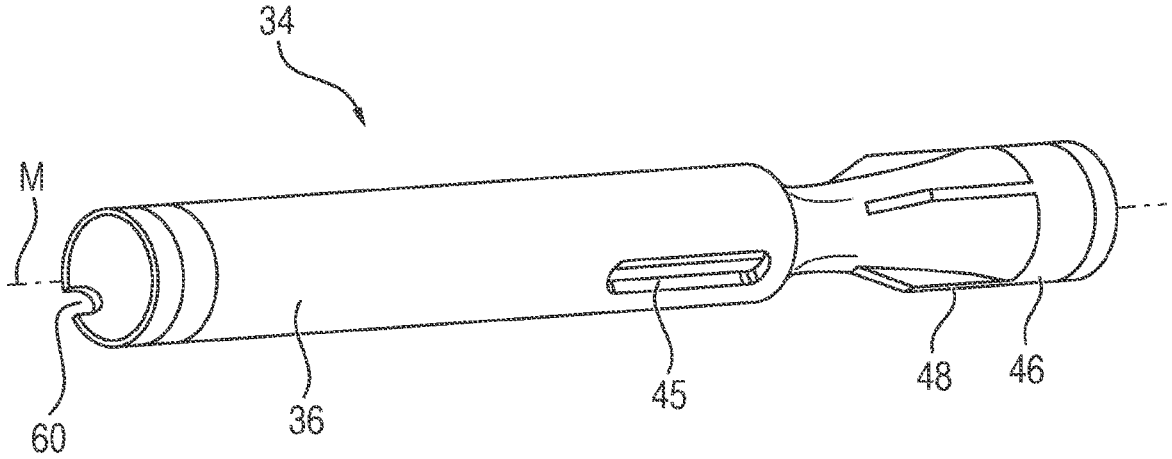
FIG. 5 is a perspective view of the separation device having a hollow-cylindrical chamber wall, which forms a separation chamber, and having a separator which is introduced in the separation chamber.
Figure 6:
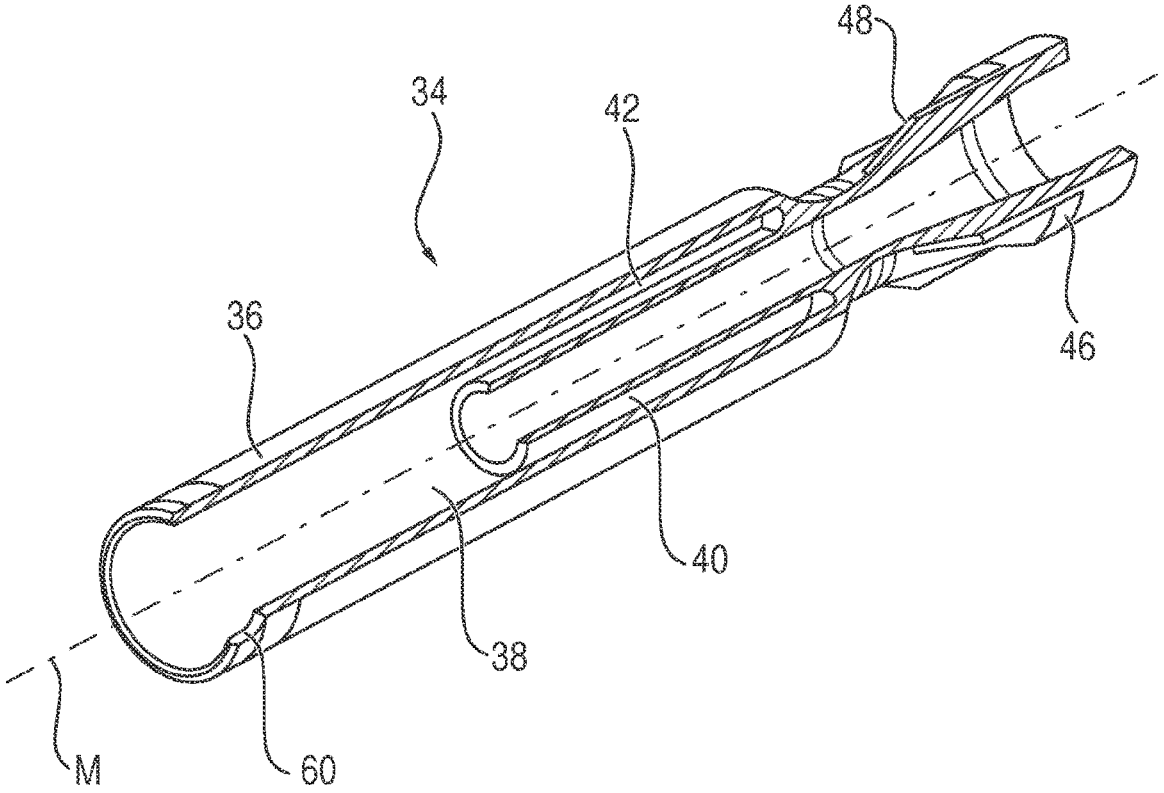
FIG. 6 is a sectioned illustration of the separation device, and an annular space is formed between the separator and the chamber wall.

FIGS. 2 and 3 show the compressor housing 12 whose housing wall 16 has a tunnel-like outlet 32 for the refrigerant K which has been compressed by means of the compressor component 18. In this instance, the outlet 32 forms a receiving member for a separation device 34 which is illustrated in FIGS. 5 and 6.

The separation device 34 has a hollow-cylindrical (tubular) chamber wall 36. This wall forms a separation chamber 38 which is connected in technical flow terms to the outlet 32. In other words, the chamber wall 36 delimits the separation chamber 38. A hollow-cylindrical separator 40 is arranged coaxially in the separation chamber 38, and between the separator 40 and the chamber wall an annular space 42 (annular gap) is formed. In addition, the separation device 34 is constructed in one piece. In other words, the chamber wall and the separator 40 are constructed in a coherent (monolithic) manner and, for example, produced by means of an injection-molding method as an injection-molded insertion component for plug-in assembly.

The separation device 34 serves to separate the lubricant S contained in the fluid F in a lubricant reservoir 44 in the manner of a centrifugal separator. The fluid F which flows via an inlet opening 45 of the chamber wall 36 into the separation chamber 38 flows in the separation chamber 38 in a helical manner (in the manner of a cyclone) around the separator 40 in the direction of the lubricant reservoir 44, and the centrifugal force acting on the refrigerant K contained in the fluid F and on the lubricant S contained in the fluid F acts as a separation mechanism. Subsequently, the refrigerant K which is separated from the lubricant S flows away through the hollow-cylindrical separator 40 and the outlet 32 into the refrigerant circuit, which is accordingly depicted with an arrow as shown in FIG. 1.

The separator 40 has a region 46 which in the direction of the center axis M of the separation device 34, that is to say, in the axial direction thereof, projects beyond the separation chamber 38. This region 46 has at the outer side a guiding contour 48 for the assembly of the separation device 34 in the outlet 32, which guiding contour 48 is formed as ribs which extend in the direction of the center axis. Using the guiding contour 48, the separation device 34 is centered in the outlet 32 during the introduction during assembly, and a tilting with respect to the provided assembly direction is prevented. Furthermore, the region 46 expands in a conical manner so that the outer diameter of the separator 40 is adapted to the inner diameter of the outlet 32.

The inlet opening of the chamber wall 36 opens in the separation chamber 38 in a radially offset manner with respect to the center axis M of the separation device 34. In addition, the inlet opening 45 is constructed in the direction of the center axis M of the separation device 34 in the manner of a slot. As a result of the radially offset inlet opening 45, the compressed fluid F flows tangentially into the annular space 42 which is formed between the separator 40 and the chamber wall 36 so that the fluid F is guided along in a selective manner only at one side of the separator 40 and an undesirable formation of turbulence is prevented. In particular, the flow cross-section formed by the clear width of the inlet opening 45 is adapted by means of the slot-like construction in the direction of the center axis M even with a radially offset arrangement of the inlet opening 45 to a conveying volume of the fluid F which occurs during operation.

The separated lubricant S is returned in a manner not illustrated in greater detail to the stationary compressor component element 20 and, furthermore, to bearings (roller or ball bearings) 50 of the electric motor 5 in order to lubricate and/or cool them.

Furthermore, the housing base 14 has an annular wall 52. This wall divides the space which is surrounded by the stationary compressor component element 20 and the compressor housing 12 into an inner annular region 54 and an outer annular region 56. The high-pressure chamber 30, also referred to as a compression chamber, is formed by the inner annular region 54 (delimited by the housing base 14), the annular wall 52 and the compressor component element 20 which is positioned on the annular wall 52.

The separation device 34 is introduced into the high-pressure chamber 30. Consequently, the high-pressure chamber 30 is coupled to the separation chamber 38 in technical flow terms by means of the inlet opening 45. The separation device 34 is in this instance arranged spaced apart from the housing base 14, and the center axis M of the separation device extends parallel with the housing base 14, that is to say, in a radial direction R. As a result of the spatial region between the separation device 34 and the housing base 14, a pressure pulsation of the fluid F is reduced. The inlet opening 45 faces the housing base 14 in this instance and consequently faces away from the compressor component outlet 28 of the compressor component 18, from which the compressed fluid F flows or is conveyed out of the compressor component into the high-pressure chamber 30.

The end of the chamber wall 36 which faces away from the outlet 32 is located in a receiving member 58 of the compressor housing 12, which receiving member is raised in a dome-like manner relative to the housing base 14 and is to the lubricant reservoir 44.

The chamber wall 36 has at the end facing away from the outlet 32, that is to say, the chamber wall end which rests in the receiving member 58, a recess 60 for receiving a twisting prevention means 64. This means is constructed as a pin and introduced into the receiving member 58 which is connected to the lubricant reservoir 44.

Figure 4:
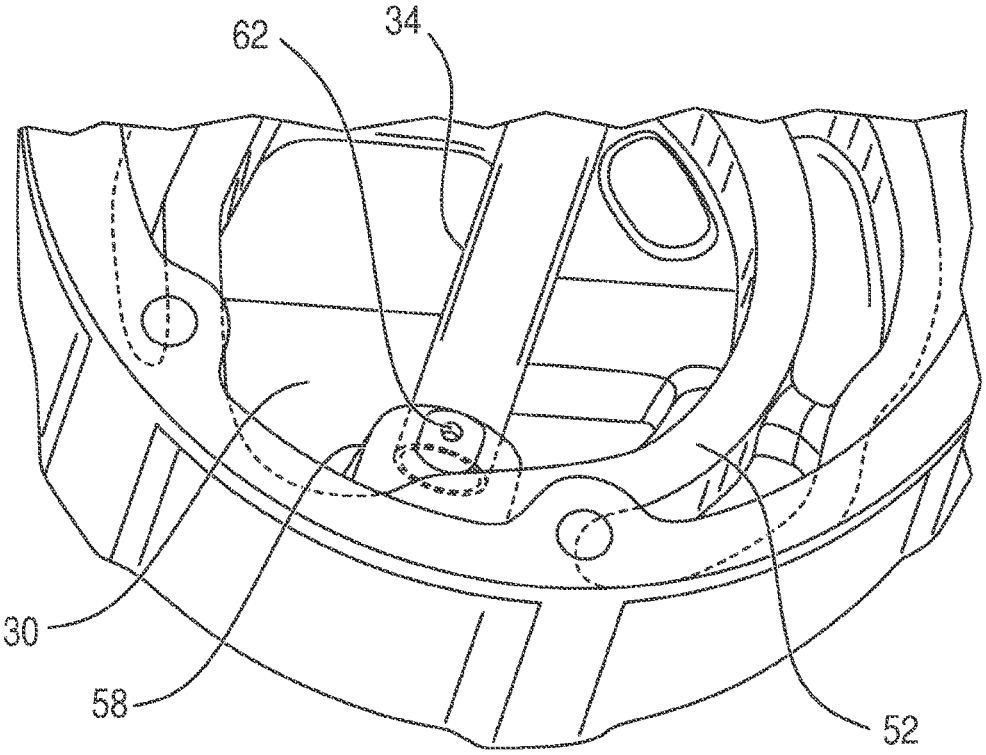
FIG. 4 is a perspective plan view of the compressor housing as a cut-out, drawn to an enlarged scale, having a receiving member in which the separation devices is located in a manner secured to the housing.

FIG. 4 shows to an enlarged scale that the recess 60 is in alignment with a passage 62 which is introduced into the receiving member 58 for receiving the twisting prevention means 64 which is constructed as a pin. Using the twisting prevention means 64, the separation device 34 is consequently secured against rotation in a manner secured to the housing.

The separation device 34 is further located in the receiving member 58 which is connected to the lubricant reservoir 44 and with the expanded region 46 thereof in the outlet, with a press-fit being formed in each case.

Figure 7:
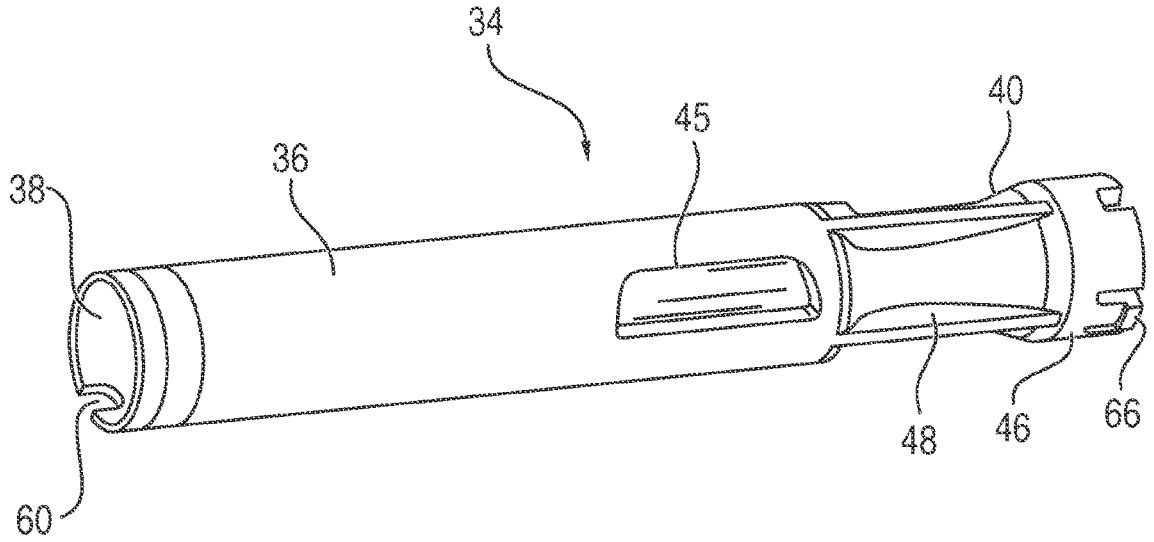
FIG. 7 is a perspective view of an alternative embodiment of the separation device, and the separator has a retention contour in a region which protrudes beyond the separation chamber.
Figure 8A:
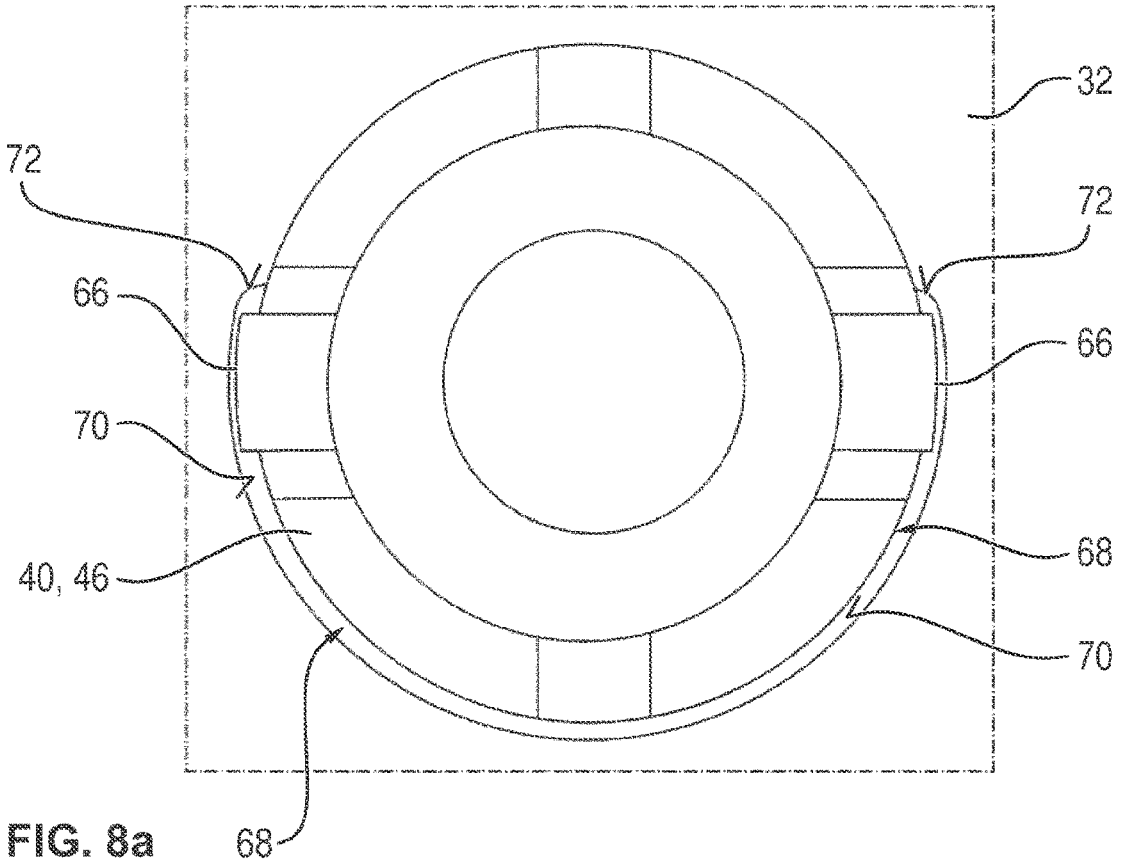
FIGS. 8*a* and 8*b* are a plan view and a perspective view of the outlet as a cut-out, with the separation device received therein according to the alternative embodiment of FIG. 7, and a retention contour of the separator which protrudes beyond the separation chamber is received in a seat of the outlet.
Figure 8B:
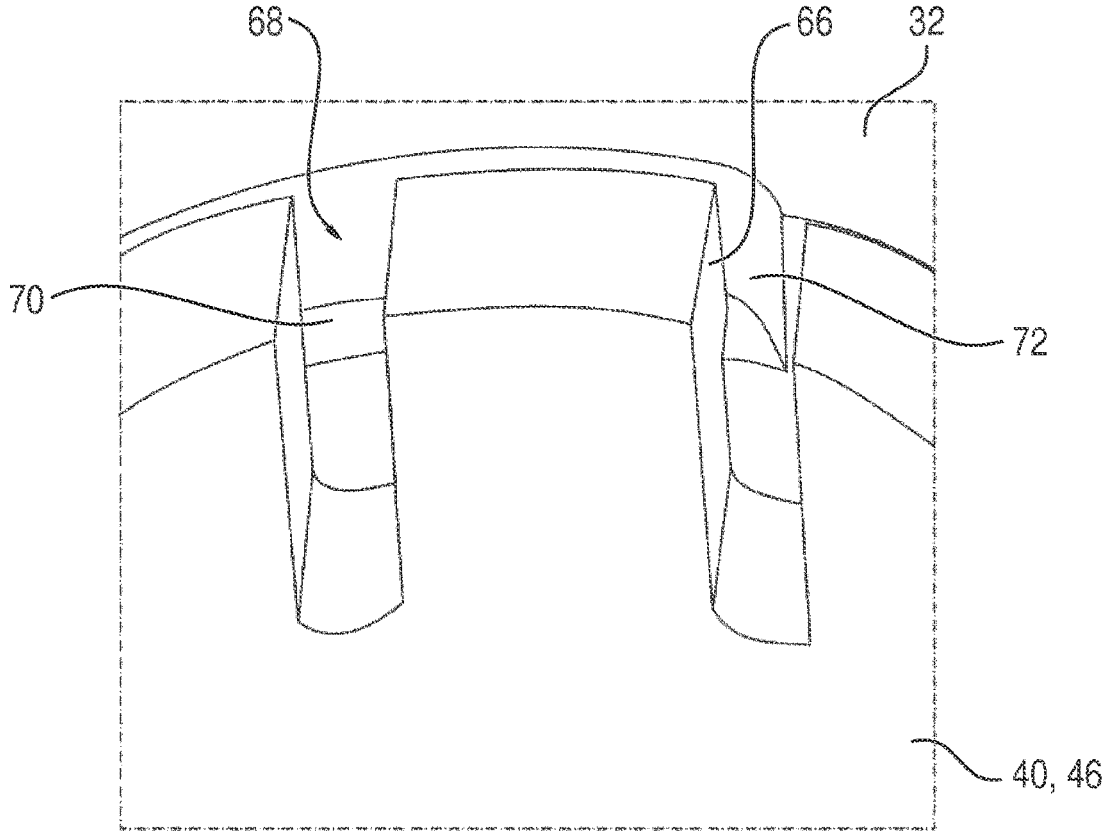

FIG. 7 shows an alternative embodiment of the separation device 34. With the exception of what is described below, the separation device 34 has the above-mentioned features so that these are not described in greater detail. The separator 40 has in the region 46 which projects beyond the separation chamber 38 a radially outwardly upwardly extending retention contour 66. This contour is constructed in this instance as two hook-like continuations which are arranged opposite each other and which in each case extend upwardly in a direction perpendicular to the center axis M of the separation device 34. In FIGS. 8*a* and 8*b*, the alternative embodiment of the separation device 34 which is received in the outlet 32 is shown, and, in the cut-out of FIG. 8*b*, only one of these continuations is illustrated, and the continuations are received in a corresponding seat 68 of the outlet 32. In this instance, a wall of the seat 68 which is orientated perpendicularly to the center axis M forms a first abutment (first shoulder 70) with respect to the direction along the center axis M. In addition, the seat 68 is not formed over the entire periphery, in this instance over half of the periphery, of the outlet 32. The seat 68 thus has two walls which extend at least partially in a plane parallel with the center axis. These walls consequently form a second abutment 72 (second shoulder 72) for the retention contour 66 which is constructed as continuations against a twisting of the separation device 34 about the center axis M thereof.

Such securing against twisting of the separation device 34 is in this instance provided and configured in a manner not illustrated in greater detail either alternatively or additionally to the twisting prevention means 64 introduced into the receiving member 58.

The invention is not limited to the embodiment described above. Instead, other variants of the invention can also be derived from it by the person skilled in the art without departing from the subject-matter of the invention. In particular, all the individual features described in connection with the embodiment can further be combined with each other in another manner without departing from the subject-matter of the invention.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

LIST OF REFERENCE NUMERALS

2 Electromotive refrigerant compressor
4 Motor module
6 Rotor
5 Electric motor
8 Stator
9 Electronics compartment
10 Compressor module
12 Compressor housing
14 Housing base
16 Housing wall
18 Compressor component
20 First compressor component element
22 Second compressor component element
24 Compressor component inlet
26 Compressor component chamber
28 Compressor component outlet
30 High-pressure chamber
32 Outlet
34 Separation device
36 Chamber wall
38 Separation chamber
40 Separator
42 Annular space
44 Lubricant reservoir
45 Inlet opening
46 Region of the separator
48 Guiding contour
50 Roller bearing
52 Annular wall
54 Inner annular region
56 Outer annular region
58 Receiving member
60 Recess
62 Passage
64 Twisting prevention means
66 Retention contour
68 Seat
70 First abutment
72 Second abutment
A Axial direction
F Fluid
K Refrigerant
M Center axis of the separation device
R Radial direction
S Lubricant While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A compressor module comprising:

a compressor housing having a substantially pot-like shape and configured to receive a refrigerant, wherein the compressor housing includes:

a housing base, and a housing wall having an outlet configured to expel a compressed refrigerant and forming a high-pressure chamber; and a single-piece separation device disposed in the high-pressure chamber and the outlet, the separation device configured to separate a lubricant mixed with the refrigerant, wherein the separation device includes a chamber wall having a hollow-cylindrical shape and forming a separation chamber that is fluidly connected to the outlet, wherein the separation device further includes a separator monolithically formed with the chamber wall and disposed in the separation chamber such that an annular space is defined between the chamber wall and the separator, wherein a region of the separator extends beyond the separation chamber along a center axis of the separation device, wherein an outer side of the region defines a guiding contour configured for assembling the separation device within the outlet, wherein the outlet defines a seat and the region includes a radially outwardly and upwardly extending retention contour configured to be received by the seat to retain the separation device in the outlet to prevent the separation device from twisting.

2. The compressor module of claim 1, wherein the annular space is in fluid communication with the separation chamber.

3. The compressor module of claim 1, wherein the outlet forms a receiving member configured to receive the separation device.

4. The compressor module of claim 1, wherein the outlet has a tunnel-like shape.

5. The compressor module of claim 1, wherein the chamber wall defines an inlet opening configured to fluidly connect the separation chamber to the high-pressure chamber.

6. The compressor module of claim 5, wherein the inlet opening is radially offset with respect to a center axis defined by the separation device.

7. The compressor module of claim 5, wherein the inlet opening faces the housing base.

8. The compressor module of claim 1, wherein the housing wall defines a receiving member configured to receive an end of the chamber wall facing away from the outlet, wherein the end is connected to a lubricant reservoir.

9. The compressor module of claim 8, wherein the chamber wall defines a recess configured to receive a twisting prevention means.

10. The compressor module of claim 9, wherein the twisting prevention means extends into the receiving member and wherein the receiving member is connected to the lubricant reservoir.

11. The compressor module of claim 8, wherein the housing wall and the housing base collectively define the lubricant reservoir.

12. The compressor module of claim 1, wherein the chamber wall defines an elongated slot to form an inlet opening, wherein the elongated slot extends along a center axis defined by the separation device.

13. The compressor module of claim 1, wherein the seat includes a first abutment cooperating with the retention contour to secure the separation device in the outlet.

14. The compressor module of claim 13, wherein the seat further includes a second abutment cooperating with another retention contour of the region to further secure the separation device in the outlet.

15. An electric refrigerant compressor configured to receive and compress a refrigerant, the electric refrigerant compressor comprising:

an electric motor; and a compressor module operatively coupled to the electric motor and including:

a housing provided with a housing base and housing wall collectively forming a high-pressure chamber and an outlet configured to expel the compressed refrigerant, and a separation device configured to separate a lubricant mixed with the refrigerant, wherein the separation device includes:

a chamber wall having cylindrical shape and forming a separation chamber, and a separator having a hollow cylindrical shape and including a first portion, disposed in the separation chamber, and a second portion extending from the first portion, wherein first portion and the chamber wall collectively define an annular space, wherein the separator and the chamber wall are integrally formed with one another, wherein a region of the separator extends beyond the chamber along a center axis of the separation device, wherein an outer side of the region defines a guiding contour configured for assembling the separation device within the outlet, wherein the outlet defines a seat and the region includes a radially outwardly and upwardly extending retention contour configured to be received by the seat to retain the separation device in the outlet to prevent the separation device from twisting.

16. The electric refrigerant compressor of claim 15, wherein the housing wall defines a receiving pocket and wherein the separation device extends between the receiving pocket and the outlet.

17. The electric refrigerant compressor of claim 15, wherein the second portion includes a guiding contour configured to position the separation device with respect to the outlet.

18. The electric refrigerant compressor of claim 17, wherein the guiding contour is formed by a number of fins extending from the chamber wall and terminating before a distal end of the second portion.

19. A compressor module comprising:

a compressor housing having a substantially pot-like shape and configured to receive a refrigerant, wherein the compressor housing includes:

a housing base, and a housing wall defining an outlet configured to expel a compressed refrigerant and forming a high-pressure chamber; and a single-piece separation device disposed in the high-pressure chamber and configured to separate a lubricant mixed with the refrigerant, wherein the separation device includes a chamber wall having a hollow-cylindrical shape and forming a separation chamber that is fluidly connected to the outlet, wherein the separation device further includes a separator monolithically formed with the chamber wall and disposed in the separation chamber such that an annular space is defined between the chamber wall and the separator, and wherein the chamber wall defines an inlet opening facing the housing base and configured to fluidly connect the separation chamber to the high-pressure chamber.

* * * * *